US005613417A

United States Patent [19]

Scobbie et al.

[11] Patent Number: 5,613,417

[45] Date of Patent: Mar. 25, 1997

[54] APPARATUS AND METHOD FOR FORMING A GROOVE IN A BOARD

[75] Inventors: Gavin Scobbie, Homewood; Thomas P. McQueeny, Chicago; Mel S. Kristmann, Lemont; Richard C. Hennessey, Chicago, all of Ill.

[73] Assignee: R. R. Donnelley & Sons Company, Lisle, Ill.

[21] Appl. No.: 629,460

[22] Filed: Apr. 10, 1996

Related U.S. Application Data

[63] Continuation of Ser. No. 175,592, Dec. 30, 1993, abandoned.

[51] Int. Cl.[6] ..... B26D 3/06

[52] U.S. Cl. ..... 83/875; 83/152; 83/153; 83/425.3; 83/425.4; 83/435.22; 83/467.1; 83/699.61; 83/856; 83/858

[58] Field of Search ..... 83/875, 425.4, 83/27, 102, 451, 467.1, 419, 435.1, 866, 151, 153, 858, 699.51, 425.3, 856, 857, 699.61, 30, 661, 152, 154; 225/103, 104

[56] References Cited

U.S. PATENT DOCUMENTS

| | | | |
|---|---|---|---|
| 662,982 | 12/1900 | Stevens | 83/451 |
| 2,304,771 | 12/1942 | Davis | 83/699.61 |
| 2,931,401 | 4/1960 | Lambert | 83/451 |
| 3,055,275 | 9/1962 | Schroter | 83/153 |
| 3,510,944 | 5/1970 | Johanski, Jr. | 83/27 |
| 3,875,835 | 4/1975 | Roberts | 83/875 |
| 4,342,349 | 8/1982 | Lipman | 83/875 |
| 4,356,744 | 11/1982 | Hamilton et al. | 83/27 |
| 4,379,419 | 4/1983 | Woock et al. | 83/875 |
| 4,604,934 | 8/1986 | Elliott et al. | 83/425.4 |
| 4,691,603 | 9/1987 | Winnemoller | 83/151 |
| 4,905,599 | 5/1990 | Richey | 83/151 |
| 4,914,996 | 4/1990 | Lavorel | 83/152 |
| 4,954,202 | 9/1990 | Price et al. | 83/875 |
| 5,111,722 | 5/1992 | Tada et al. | 83/153 |
| 5,249,493 | 10/1993 | Breton | 83/154 |
| 5,275,075 | 1/1994 | Keech et al. | 83/875 |

FOREIGN PATENT DOCUMENTS

| | | | |
|---|---|---|---|
| 2009016 | 6/1979 | United Kingdom | 83/875 |

*Primary Examiner*—Eugenia Jones
*Assistant Examiner*—Charles Goodman
*Attorney, Agent, or Firm*—Marshall, O'Toole, Gerstein, Murray & Borun

[57] ABSTRACT

In order to enhance the effectiveness and efficiency of forming a groove in a board, an apparatus and method are disclosed. The apparatus includes a station for feeding the board from a supply of boards, a table for supporting the board upon receipt from the feeding station, a cutter for forming the groove while the board is supported by the table, and a station for removing the board after the groove has been formed. It is among the unique aspects of the disclosure that the table is moved relative to the cutter such that a grooved board can be removed from the table with the material defining the groove having been separated therefrom just after another board on the table has been grooved. The method includes the steps of feeding the board from a supply of boards at a feeding station, supporting the board after the board has been fed from the feeding station, forming the groove in the board while the board is being supported, and removing the board after forming the groove at a removing station. With the unique features of the disclosure, it is possible to cut a plurality of V-shaped grooves in a board of foam having a puzzle facing material thereon to form foldable corner pieces for a three-dimensional puzzle.

26 Claims, 5 Drawing Sheets

APPARATUS AND METHOD FOR FORMING A GROOVE IN A BOARD

This is a Continuation of U.S. application Ser. No. 08/175,592, filed Dec. 30, 1993, now abandoned.

FIELD OF THE INVENTION

The present invention is very generally related to machining, milling, cutting and the like and, more particularly, to an apparatus and method for forming a groove in a board.

BACKGROUND OF THE INVENTION

Over the years, there have been developed a large number of different types of devices for machining, milling, cutting and the like. These devices have run the gamut from simple hand tools to sophisticated and expensive computer controlled machinery that is now commonplace in many modem industrial settings. Generally speaking, these developments have been geared to address the problems that are encountered in a particular application.

For instance, there are a wide variety of different hand tools that are specifically geared to fine craftsmanship. These tools are extremely well suited for their intended use but would obviously be worthless for utilization in a mass production setting. Concomitantly, the possibility of utilizing an expensive computer controlled machine is of little interest to the artisan.

In the former case, the hand tools would have such a deleterious effect on acceptable productivity standards as to be immediately rejected for use in a mass production setting. In the latter case, the expense of the computer controlled machinery could not be justified and would be useless to the artisan who is producing a one-of-a-kind work of craftsmanship.

Similarly manner, it is recognized that there is a need for specialized equipment for performing a variety of different tasks. It is oftentimes the case that a new product will be developed that has great market potential if it can be manufactured in an effective and efficient manner. Without this capability, the new product may well never reach the market place at all much less meet its full market potential.

In this connection, a new product of quite recent vintage is the three-dimensional puzzle which has been gaining in popularity. Unfortunately, there has heretofore been a need to join puzzle pieces by using tenon and mortise joints at every corner, e.g., where two walls meet in a castle or other structure. As a result, the castle or other structure has an unrealistic appearance resembling a log cabin due to the tenon and mortise joints.

More recently, there has been developed an entirely unique and far more satisfying corner structure that will undoubtedly cause a significant increase in the popularity of three-dimensional puzzles. This corner structure gives an entirely realistic appearance to the fully assembled caste or other structure at every corner by reason of "wrap-around" corner pieces, i.e., flat corner pieces bendable to a substantially right angle during assembly of the puzzle, whereby the puzzle facing material is uninterrupted or continuous unlike the tenon and mortise joint arrangement. More specifically, the unique puzzle corner is disclosed and claimed in the co-pending patent application of McQueeny et at. for: Three-Dimensional Puzzle, U.S. Ser. No. 08/147,052, Filed Nov. 3, 1993.

For purposes of better understanding the present invention, the teachings of the McQueeny et at. '052 patent application are fully incorporated herein by reference.

In connection with the puzzle corner pieces disclosed in the McQueeny et al. '052 patent application, they involve the utilization of a V-shaped groove in the foam backing material. This groove extends substantially through the backing material but does not in any way penetrate the puzzle facing material which is typically a lithographic sheet bonded to the foam. While this works very effectively as a puzzle corner, it is necessary to be able to mass produce all portions of the three-dimensional puzzle including the corner pieces.

To accomplish this objective, it must be possible to form the grooves in the foam backing material in an effective and efficient manner. This would ideally be done in a manner requiring a minimum of labor and relatively inexpensive machinery where there is virtually no lost motion so that productivity levels can be maintained at a very high level. In addition to the manufacture of puzzles, there may also be still other applications where it is necessary to form a groove in a board.

The present invention is directed to overcoming one or more of the foregoing problems and achieving one or more of the resulting objects.

SUMMARY OF THE INVENTION

Accordingly, it is a principal object of the present invention to provide an entirely new and unique apparatus and method particularly well adapted for forming a groove in a board or the like. It is a further object of the present invention to do this in a highly effective and efficient manner. Additionally, it is an object of the present invention to cut a plurality of V-shaped grooves in a board of foam having a puzzle facing material thereon to form foldable corner pieces for a three-dimensional puzzle.

As a result, and in a most general sense, the present invention is directed to an apparatus and method for forming a groove in a board. The apparatus includes a station for feeding a board from a supply of boards, means for supporting the board upon receipt from the station, means for forming the groove while the board is supported, and a station for removing the board after the groove has been formed. The method includes the steps of feeding a board from a supply of boards at a feeding station, supporting the board after the board has been fed from the feeding station, forming the groove in the board while the board is being supported, and removing the board after forming the groove at a removing station. Clearly, the apparatus and method of the present invention can potentially have a wide range of different applications. In a most highly preferred application, however, the apparatus and method are especially well suited for cutting a plurality of V-shaped grooves in a board of foam having a puzzle facing material thereon to form foldable corner pieces for a three-dimensional puzzle.

In the preferred embodiment, the apparatus includes a generally rectangular frame supported by a plurality of legs, and the feeding station is centrally positioned along one side of the generally rectangular frame. It is also advantageous for the board supporting means to comprise a generally rectangular board-receiving table supported by the frame so as to be disposed in a generally horizontal plane, with the board also being generally rectangular and planar so as to be positionable flat upon an upper surface of the table. As for the groove forming means, it preferably includes means for removing a portion of the foam comprising the board to form the V-shaped grooves therein and means for imparting relative movement between the table and foam removing means.

More specifically, the relative movement imparting means preferably includes a track and roller system which is adapted to support the table for linear motion toward and away from opposite ends of the rectangular frame and relative to the foam removing means. It will also further include a drive cylinder associated with the table for imparting linear motion of a preselected distance to the table through the track and roller system. As for the foam removing means, it advantageously includes a plurality of fixedly mounted cutters, each having a pair of blades positioned closely adjacent and above the table for forming the V-shaped grooves in the foam of the board during relative movement therebetween.

In addition, the apparatus preferably includes means for separating the portion of the foam comprising the grooves from the remainder of the board after the grooves have been formed in the board by the groove forming means. Still additionally, the apparatus advantageously includes a station centrally positioned along the other side of the frame from the feeding station for removing the board after the grooves have been formed.

As for other features of the invention, the apparatus preferably includes vacuum means associated with the table. This serves to maintain the generally planar board in a flat position in a generally horizontal plane on the board-receiving table, and the table also preferably includes a stop for positioning one edge of the board thereagainst and a marking for positioning another edge of the board thereagainst. In other words, the stop and marking serve to properly position the board to ensure that the grooves are formed in the desired location.

With regard to the cutters, they each preferably include a supporting block mounted on a pair of rods extending generally from one side of the frame to the other side of the frame so as to be supported at opposite ends by the frame and a blade carrying face plate mounted to the supporting block. Also, the cutters advantageously each include means for releasably securing the supporting block in a selected horizontal position of adjustment along the rods, i.e., transversely of the direction of travel of the table, and means for releasably securing the face plate in a selected vertical position of adjustment relative to the supporting block and, thus, relative to the upper surface of the table. Still further, the face plates each preferably include a generally V-shaped blade carrying extension disposed below the supporting block, and the blades comprise razor blades secured to the blade carrying extension so as to be inclined downwardly and rearwardly in the direction of travel of the board.

In other respects, the foam separating means preferably includes a plurality of reciprocating pin assemblies each having a pin pivotally mounted on a supporting block which is positioned on a rod extending generally from one side of the frame to the other side of the frame. The rod is advantageously supported at opposite ends by the frame. The pins are each preferably carried by one end of an arm mounted to have an intermediate pivot point and spring means is provided for normally biasing the pins in a direction away from the portion of the foam comprising the grooves in the board. The pin assemblies each preferably include means for releasably securing the supporting blocks in selected horizontal positions of adjustment along the rod, i.e., transversely of the direction of travel of the table. Means are provided for imparting pivotal movement to the pin against normal biasing by the spring means. Still additionally, the pin assemblies each advantageously include a pin stripper mounted on the supporting block through which the pin moves first to engage and separate the portions of the foam cut for removal from the board to form the grooves and then to discard the portions of the foam following separation.

In still other respects, the pivotal movement imparting means includes a pivotally mounted rod assembly overlying the arms of the pin assemblies opposite the pins and a drive cylinder is associated with the rod assembly for pivoting the arms and pins against normal biasing by the spring means. It is also highly advantageous for the cutters to be positioned on each side of and generally adjacent the feeding and removing stations, i.e., to have a two stage apparatus, with corresponding pin assemblies also preferably positioned generally outwardly of and in longitudinal alignment with each of the sets of cutters in proximity to each of the opposite ends of the frame such that the drive cylinder associated with the board-receiving table first imparts linear motion of a preselected distance toward one end of the frame, stops, and then imparts linear motion of a preselected distance toward the other end of the frame. Further, the apparatus advantageously includes means for controlling operation of the drive cylinders associated with the board-receiving table and the pin assemblies such that the pins engage the portions of the foam comprising the grooves after the board-receiving table has traveled the preselected distance.

Other objects, advantages and features of the present invention will become apparent from a consideration of the following specification taken in conjunction with the accompanying drawings.

DETAILED DESCRIPTION OF THE PREFERRED EMBODIMENT

Figure 1:
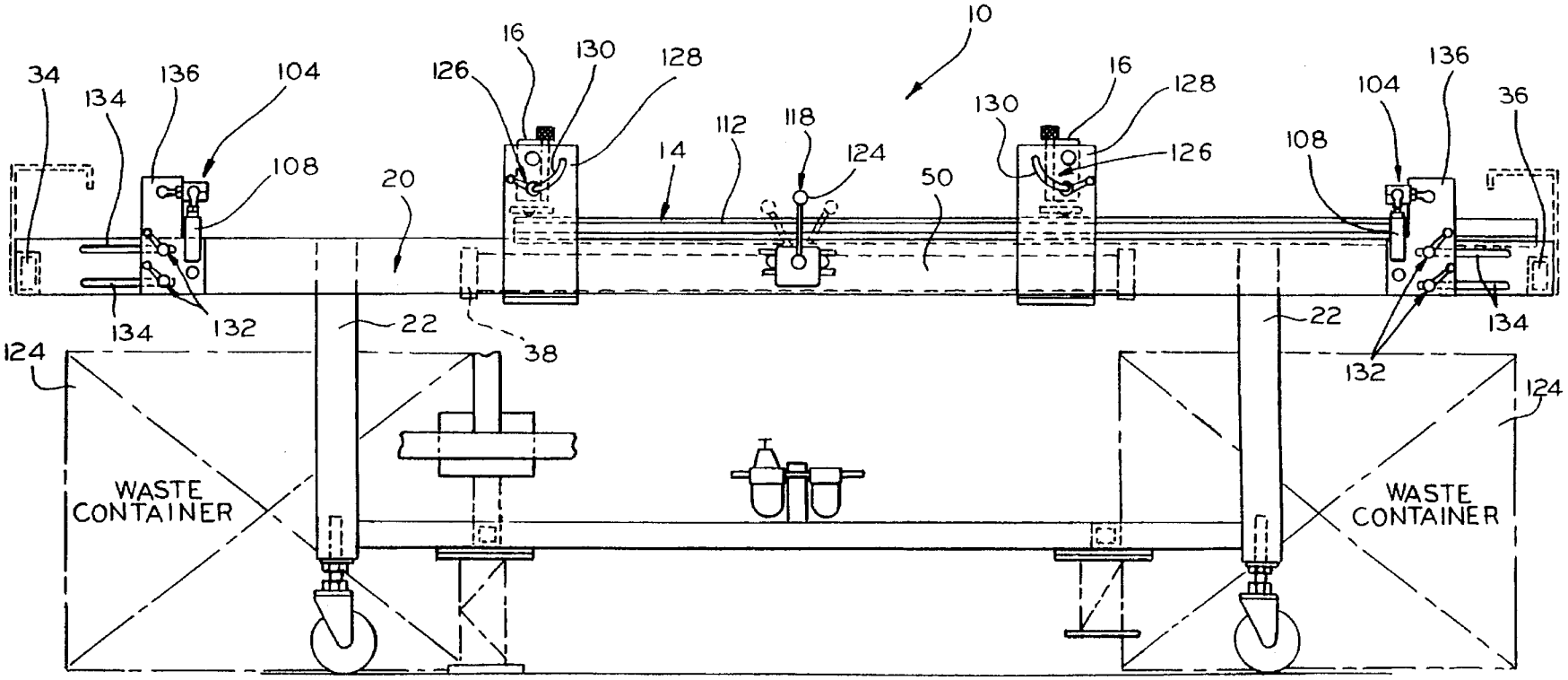
FIG. 1 is a side elevational view of an apparatus for forming a groove in a board in accordance with the present invention.

In the illustrations given, and with reference first to FIG. 1, the reference numeral 10 designates generally an apparatus for forming a groove in a board in accordance with the present invention. The apparatus 10 includes a station 12 for feeding a board from a supply of boards (see FIG. 2). It also includes means for supporting the board upon receipt from the station 12 in the form of a board-receiving table 14 and means for forming the groove while the board is supported in the form of a cutter 16 (see FIGS. 1, 2, 4 and 5). The apparatus further includes a station 18 for removing the board after the groove has been formed (see FIG. 2). With this arrangement, the apparatus 10 is well suited for many applications, including cutting a plurality of V-shaped grooves in a board of foam having a puzzle facing material thereon to form foldable corner pieces for a three-dimensional puzzle.

Figure 2:
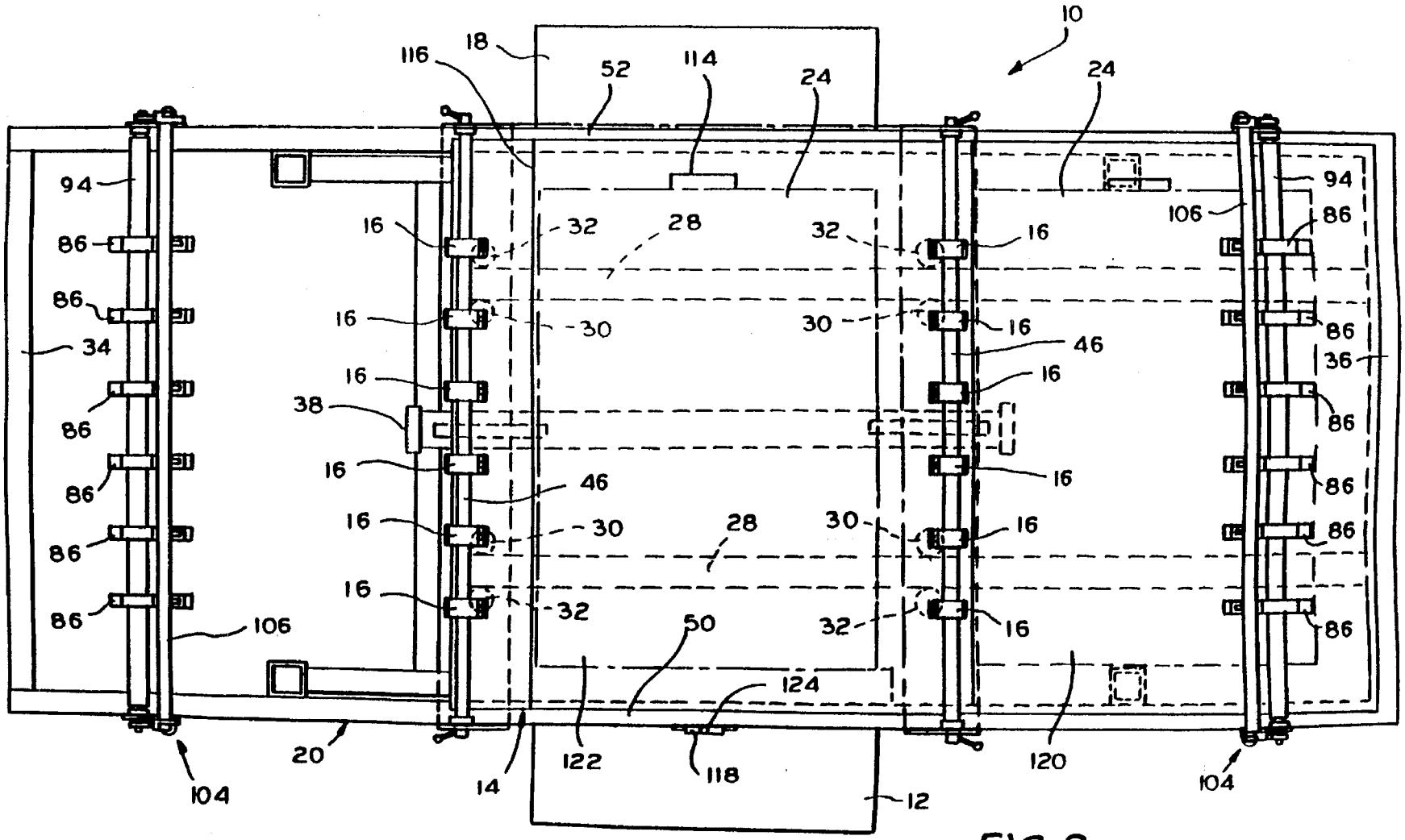
FIG. 2 is a top plan view of the apparatus as illustrated in FIG. 1.
Figure 3:
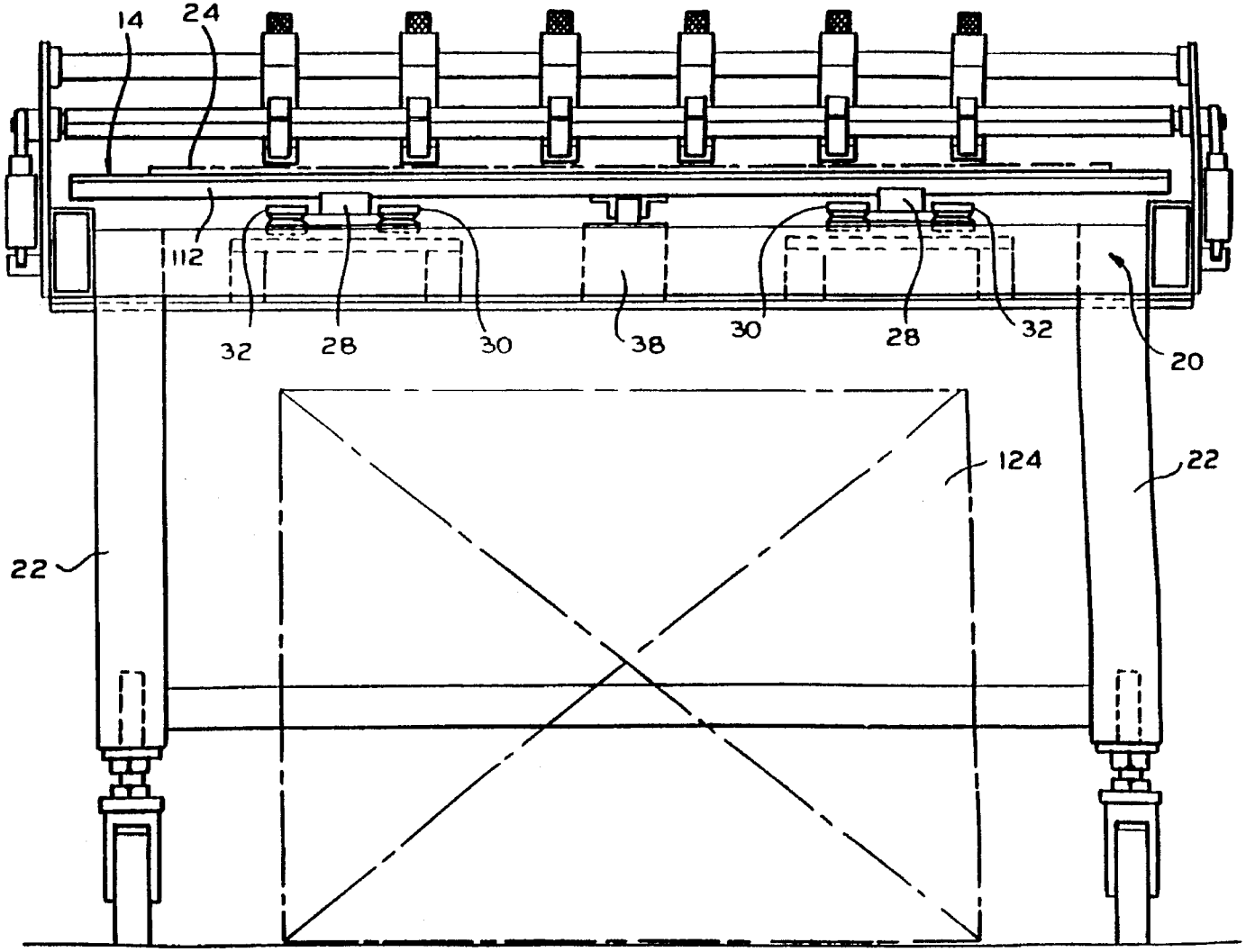
FIG. 3 is an end elevational view of the apparatus as illustrated in FIG. 1.

Referring to FIGS. 1–3, the apparatus 10 includes a generally rectangular frame 20 supported by a plurality of legs 22, and the feeding station 12 is centrally positioned along one side of the frame 20 for feeding the boards from a supply of boards. The table 14 will be seen to be a generally rectangular board-receiving table which is supported by the frame 20 so as to be disposed in a generally horizontal plane, and the boards such as 24 are generally rectangular and planar so as to be positioned flat upon an upper surface of the table 14. As for the groove forming means or cutters 16, they will be understood to serve as suitable means for removing a portion of the foam or other material comprising the boards 24 in order to form the generally V-shaped grooves such as 26 therein (see FIG. 7).

In addition to the foregoing, the apparatus 10 includes means for imparting relative movement between the board-receiving table 14 and the foam or other material removing means or cutters 16. The relative movement imparting means preferably includes a track and roller system 28, 30, 32 for supporting the board-receiving table 14 for linear motion toward and away from opposite ends 34 and 36 of the rectangular frame 20, and also relative to the foam or other material removing means or cutters 16. Additionally, a drive cylinder 38 is associated with the board-receiving table 14 for imparting reciprocating linear motion of a preselected distance to the board-receiving table 14 through the track and roller system 28, 30, 32.

Referring specifically to FIGS. 1–3, 4 and 5, the foam or other material removing means or cutters 16 include a plurality of fixedly mounted cutters, each having a pair of blades 40 and 42 positioned closely adjacent and above the board-receiving table 14 for forming the V-shaped grooves 26 in the foam of the boards 24 during relative movement therebetween. The cutters 16 each include a supporting block 44 mounted on a pair of rods 46 and 48 extending generally from one side 50 of the frame 20 to the other side 52 of the frame 20 so as to be supported at opposite ends by the frame 20 and a blade carrying face plate 54 is mounted to the supporting block 44. The cutters 16 each also include means 56 for releasably securing the supporting block 44 in a selected horizontal position of adjustment along the rods 46 and 48 and means 58 for releasably securing the face plate 54 in a selected vertical position of adjustment relative to the supporting block 44 and the board-receiving table 14. In the illustrated embodiment, the releasable securing means 56 may take the form of a threaded fastener **56*a* having a handle 56*b* integral therewith for rapidly loosening and tightening the fastener 56*a* to make adjustments in the horizontal position of the cutters 16** in a manner that will be further described below.

Figure 5:
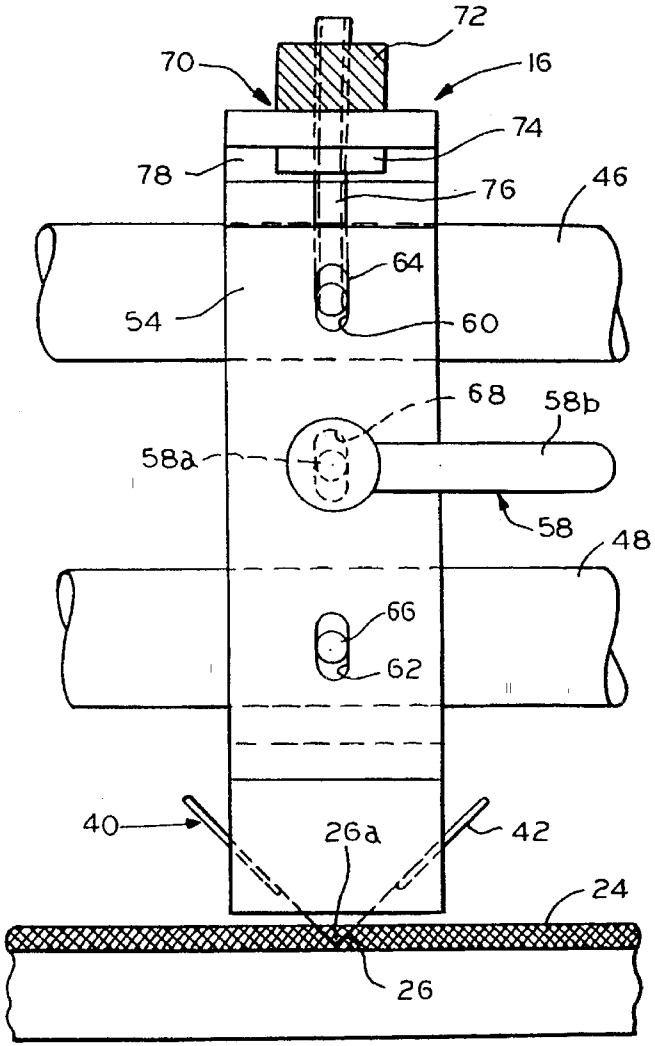
FIG. 5 is a front elevational view of the cutter as illustrated in FIG. 4.
Figure 4:
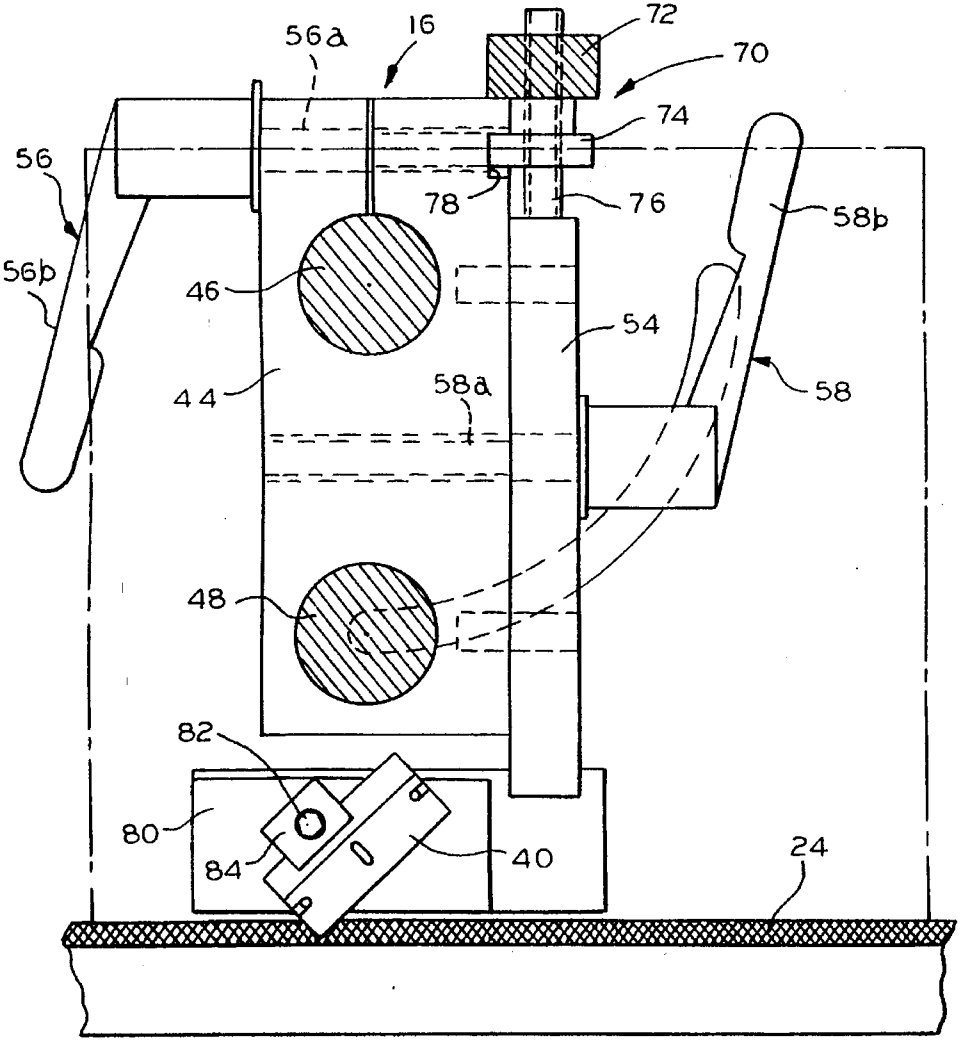
FIG. 4 is a side elevational view of a cutter for the apparatus as illustrated in FIG. 1.

Referring to FIGS. 4 and 5, the releasable securing means 58 may take a similar but somewhat different form due to the fine adjustment that is required in the depth of penetration of the blades 40 and 42 into the foam of the boards 24 which must not penetrate into any facing material thereon. The releasable securing means 58 may also include a threaded fastener **58*a* having a handle 58*b* integral therewith for rapidly tightening and loosening the face plate 54 in a selected vertical position of adjustment relative to the supporting block 44, but, for vertical adjustability purposes, the face plate 54 includes upper and lower slots 60 and 62 designed to receive pins 64 and 66 projecting horizontally outwardly from the front face of the supporting block 44 to maintain vertical alignment, and the face plate 54 also includes a slot 68 through which the fastener 58*a* extends. In addition to the releasable securing means 58, the cutters 16 will also be seen to include a unique fine adjustment thumbscrew system, generally designated 70, to very accurately position the depth to which the blades 40 and 42 will cut into the foam of the boards 24**.

More specifically, the thumbscrew system 70 will be seen and understood to include upper knurled knob 72 and lower smooth knob 74 which are both integral with a threaded fastener 76 that is vertically moveable toward and away from the remainder of the face plate 54 by reason of threaded engagement of the threaded fastener 76 with a threaded bore in the face plate 54. The knobs 72 and 74 are separated by a distance substantially the same as the distance between the top of a slot 78 in the supporting block 44 and the top surface of the supporting block 44. In this manner, the upper knurled knob 72 can be turned clockwise or counterclockwise to raise or lower the depth of penetration of the blades 40 and 42 when the threaded fastener **58*a* has been loosened by using the handle 58*b* following which the threaded fastener 58*a* can be firmly tightened by using the handle 58*b* to maintain the blades 40 and 42** in the desired vertical position of adjustment.

As for other details of the cutters 16, the face plates 54 each include a generally V-shaped blade carrying extension 80 which is disposed below the supporting block 44 and has vertical clearance to permit vertical adjustment in the manner previously described. In this connection, the blades 40 and 42 may suitably comprise razor blades secured to the blade carrying extension 80 by means of a fastener 82 and clip 84 so as to be inclined downwardly and rearwardly in the direction of travel of the boards 24.

Figure 7:
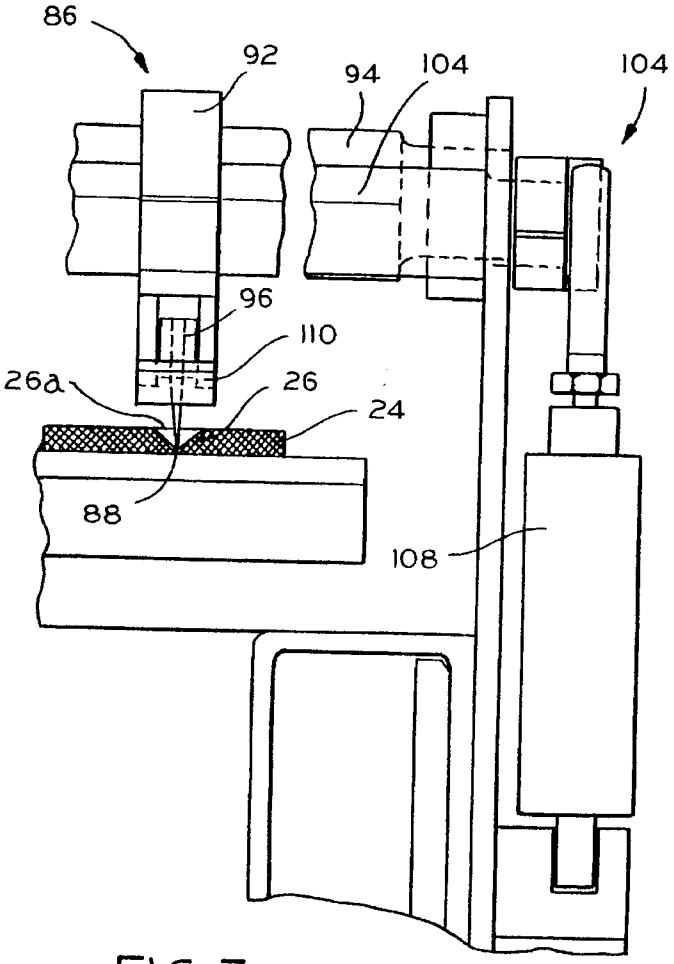
FIG. 7 is a front elevational view of the strip separator as illustrated in FIG. 6.
Figure 6:
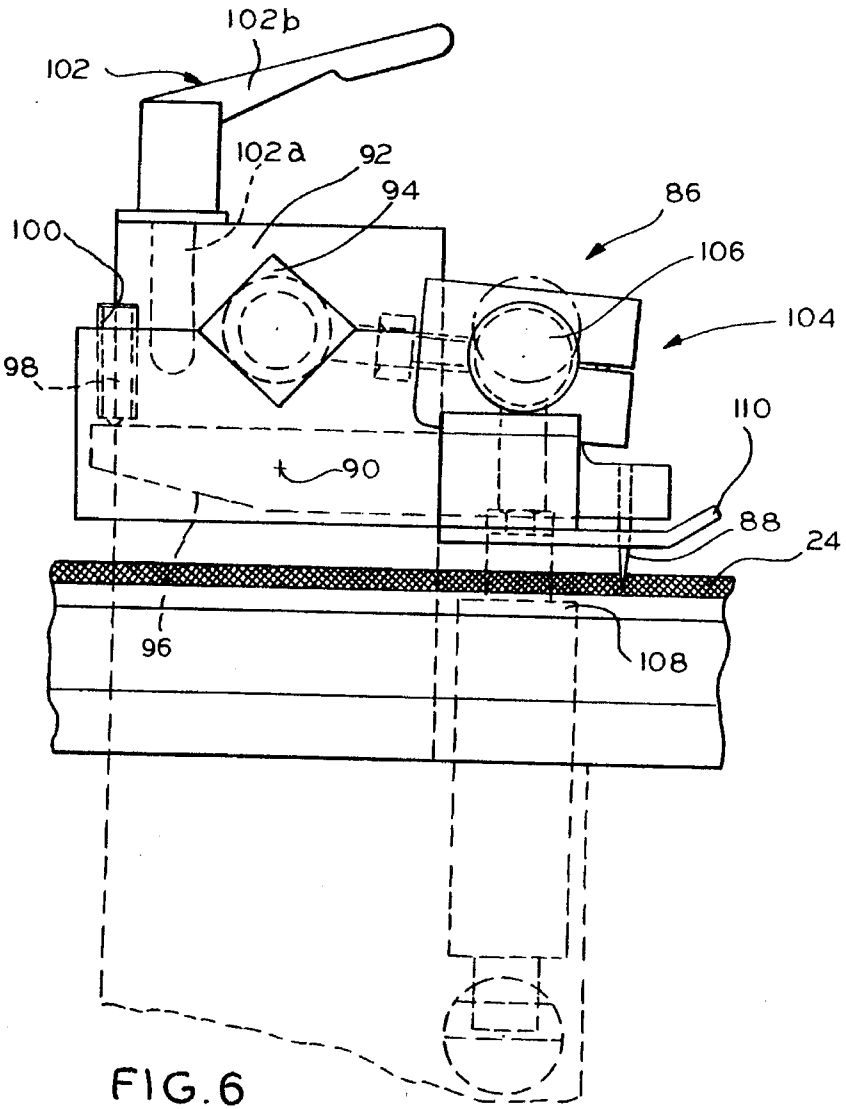
FIG. 6 is a side elevational view of a strip separator for the apparatus as illustrated in FIG. 1.

In addition to the foregoing, the apparatus 10 includes means for separating from the remainder of the boards 24 the generally V-shaped elongated strips **26*a* which are the portions of the foam cut to form the grooves 26 after the grooves have been formed in the boards by the cutters 16 (see FIGS. 6 and 7). The separating means includes a plurality of reciprocating pin assemblies 86 each including a pin 88 pivotally mounted about the pivot point 90 on a supporting block 92 positioned on a non-circular rod 94 extending generally from one side 50 of the frame 20 to the other side 52 of the frame 20 (see also FIG. 2). The rod 94 is supported at opposite ends by the frame 20, and the pins 88 are each carried by one end of a rocker arm 96 having an intermediate pivot point 90 and including spring means such as the compression spring 98 which is suitably disposed in a spring carrying sleeve 100 for normally biasing the pin 88 through the rocker arm 96 in a direction away from the corresponding portion 26*a* of the foam cut to define the groove 26. Additionally, the pin assemblies 86 each include means 102 for releasably securing the supporting block 92 in a selected horizontal position of adjustment along the non-circular rod 94 which again can be a threaded fastener 102*a* that can be loosened and tightened by means of an integral handle 102*b***.

Referring FIGS. 1, 2, 6 and 7, the apparatus 10 includes means for imparting pivotal movement to the pins 88 against normal biasing by the springs 98 which comprises a pivotally mounted rod assembly 104 having a rod 106 overlying the rocker arms 96 of the pin assemblies 86 generally opposite the pins 88. It also will be seen to have at least one and preferably a pair of drive cylinders 108 operatively associated with the rod assembly 104 for pivoting the rocker arms 96 and pins 88 against normal biasing by the springs 98. With this arrangement, the pin assemblies 86 each include a pin stripper 110 mounted on the supporting block 92 through which the pin 88 moves to engage and separate the corresponding strip 26*a* cut to form one of the grooves 26 and then to discard the strip 26*a* when the pin 88 is retracted through the pin stripper 110.

As for other features of the invention, the apparatus 10 preferably includes vacuum means associated with the table 14 for maintaining the generally planar board 24 in a flat position in a generally horizontal plane on the board-receiving table 14. This is advantageously accomplished by having a plurality of very small, closely spaced holes through the surface of the table 14 leading to a vacuum chamber 112 therewithin. In addition, the board-receiving table 14 preferably includes a stop 114 for positioning one edge of the boards 24 thereagainst and a marking 116 for positioning another edge of the boards 24 thereagainst.

In the preferred embodiment as illustrated, the apparatus 10 includes cutters 16 which are positioned on each side of and generally adjacent the feeding and removing stations 12 and 18, and the pin assemblies 86 are positioned generally outwardly of and in longitudinal alignment with the cutters 16 on both sides of the stations 12 and 18 in proximity to each of the opposite ends 34 and 36 of the frame 20. The board-receiving table 14 will be seen from FIGS. 1 and 2 to extend approximately ⅔ the length of the frame 20 such that the reciprocating drive cylinder 38 associated with the table 14 first imparts linear motion of a preselected distance toward one end 34 of the frame 20, stops, and then imparts linear motion of a preselected distance toward the other end 36 of the frame 20. Still additionally, the apparatus 10 will be understood to include control means generally designated 118 for controlling operation of the drive cylinders 38 and 108 associated with the board-receiving table 14 and the pin assemblies 86 such that the pins 88 engage the generally V-shaped elongated strips 26*a* after the board-receiving table 14 has traveled the preselected distance therefor.

As will be appreciated from the foregoing, an operator may be positioned at both the feed station 12 which is centrally positioned along one side 50 of the frame 20 for feeding the boards 24 one at a time from a supply of the boards, and another operator may be positioned at the removing station 18 which is centrally positioned along the other side 52 of the frame 20 from the feeding station 12 for removing the boards 24 after the grooves 26 have been formed therein.

In operation, the operator at the feed station 12 will place one of the boards 24 at one of the pair of board placement positions such as 120 and 122 against the corresponding stop 114 and marking 116. The handle 124 of the hand valve control means 118 will then be moved to the right as shown in FIG. 1 (assuming the position 120 is first filled) which will cause the table 14 to travel to the right to the position illustrated during which a plurality of grooves 26 will be formed in the board 24 by the cutters 16 to the right of center of the apparatus 10. The table 14 then stops and the pins 88 engage the strips 26*a* at which time the operator at the feed station 12 places another board 24 against the stop 114 and generally in alignment with the marking 116 (whereby the position 122 is then filled). When this is done, the operator at the feed station 12 moves the handle 124 of the hand valve control means 118 to the left as viewed in FIG. 1 which causes the table 14 to travel in the opposite direction to a point adjacent the opposite end 34 of the frame 20.

As this is occurring, the pins 88 which have already engaged the strips 26*a* in the board 24 at the position 120 separate the strips 26*a* from that board 24, and the cutters 16 to the left of center of the apparatus 10 cut the grooves 26 in the board 24 at the position 122 on the table 14. The table completes its travel to the left as viewed in FIG. 1 and the pins 88 which have separated the strips 26*a* from the board 24 at the position 120 are retracted through their pin strippers 110 by action of the springs 98 following release of pressure by the rod 106 through the drive cylinders 108 causing the strips 26*a* to fail into a waste container 124. When travel is completed to the left as viewed in FIGS. 1 and 2, the table 14 again stops, the pins 88 to the left of center engage the strips 26*a* cut in the board 24 at the position 122, and the operator at the removing station 18 removes the grooved board 24 from the position 120.

Immediately following the removal of the grooved board 24 from the position 120, the operator at the feed station 12 places another board 24 at the station 120 to be processed.

As for other details of the invention, the cutters 16 may also be mounted so as to be angularly adjustable in order to still further control the cutting action that can be achieved for forming a groove in a board or the like. This may, by way of example, done by providing a releasable securing means 126 in the form of a handle and threaded fastener of the type previously described in connection with the cutters 16 and the pin assemblies 86 which tightens and loosens the rod 48 relative to a mounting flange 128 having a curved slot 130 therein which makes it possible to pivot the cutters 16 to an angle other than purely vertical relative to the table 14. Also, the linear position of the pin assemblies 86 can be altered in a like fashion by means of similar releasable securing means 132 and slots 134 in the frame whereby the pin assemblies 86 can be slideably adjusted through the supporting flanges 136.

From the foregoing, it will be appreciated that the present invention is susceptible of many different uses. It will also be understood that the present invention provides a unique method of forming a groove in any board, and, in a particularly advantageous and specific application, a method is provided for cutting a plurality of V-shaped grooves in a board of foam having a puzzle facing material thereon to form foldable corner pieces for a three-dimensional puzzle. Still additionally, the present invention may well be found to have other unique applications in various industrial and commercial settings.

While in the foregoing there has been set forth a preferred embodiment of the invention, it will be appreciated that the details herein given may be varied by those skilled in the art without departing from the true spirit and scope of the appended claims.

What is claimed is:

1. An apparatus for forming grooves in boards, comprising:

a feeding station for feeding said boards one at a time from a supply of said boards;

a board-receiving table disposed in a generally horizontal plane for supporting said boards upon receipt from said feeding station;

said boards being generally planar so as to be supported flat on said table, said table supported by a frame, said frame including a first location generally adjacent said feeding station for receiving said boards from said feeding station, said frame also including a second location and a third location;

said second location being positioned on one side of said first location and spaced from said feeding station, said third location being positioned on the other side of said first location and spaced from said feeding station;

groove forming means for forming said grooves while said boards are supported including:

material removing means for removing a portion of the material comprising said boards to form said grooves therein, and means for imparting reciprocating movement to said table relative to said material removing means and said frame, said table being movable relative to said frame to transfer one of said boards between said first location and said second location, said table also being movable relative to said frame to transport another of said boards between said first location and said third location;

said material removing means removing material as a first one of said boards moves with said table from said first location to said second location and also as a second one of said boards moves with said table from said first location to said third location;

material separating means for separating the portion of the material comprising said grooves from the remainder of said boards after said grooves have been formed in said boards by said material removing means;

said material separating means separating material removed from said boards by said material removing means as said first one of said boards moves from said second location to said first location and also as said second one of said boards moves from said third location to said first location; and a removing station located generally adjacent said first location for removing said boards from said after said grooves have been formed and said material has been separated;

said material removing means operating on said second one of said boards while said material separating means is operating on said first one of said boards;

said first one of said boards being removed from said table at said removing station when said table is at said first location after said material separating means has separated material from said first one of said boards; and a third one of said boards being fed to said table from said feeding station while said table is still at said first location following removal of said first one of said boards.

2. The apparatus of claim 1 wherein said board feeding station is positioned on one side of said board-receiving table and said board removing station is positioned on the other side of said board-receiving table.

3. The apparatus of claim 1 including vacuum means associated with said table for maintaining said generally planar board in a flat position in said generally horizontal plane on said board-receiving table.

4. The apparatus of claim 1 wherein said board-receiving table includes a stop for positioning one edge of said boards thereagainst and a marking for positioning another edge of said boards thereagainst.

5. The apparatus of claim 1 wherein said material removing means includes a pair of blades positioned closely adjacent and above said board-receiving table for forming said groove in a generally V-shape.

6. The apparatus of claim 1 wherein said movement imparting means includes a track and roller system for supporting said table for linear motion relative to said material removing means.

7. The apparatus of claim 6 further including a drive cylinder associated with said table for imparting linear motion to said table through said track and roller system.

8. The apparatus of claim 1 wherein said material separating means includes a plurality of reciprocating pins for engaging the portions of the material comprising said grooves after said grooves have been formed by said material removing means.

9. An apparatus for cutting V-shaped grooves in boards of foam having a facing material thereon, comprising:

a feeding station for feeding said boards one at a time from a supply of said boards;

a board-receiving table disposed in a generally horizontal plane for supporting said boards upon receipt from said feeding station;

said boards being generally planar so as to be supported flat on said table, said table supported by a frame, said frame including a first location generally adjacent said feeding station for receiving said boards from said feeding station, said frame also including a second location and a third location;

said second location being positioned on one side of said first location and spaced from said feeding station, said third location being positioned on the other side of said first location and spaced from said feeding station;

groove forming means for forming said grooves while said boards are supported including:

foam removing means for removing a portion of said foam comprising said boards to form said V-shaped grooves therein and means for imparting reciprocating movement to said table relative to said foam removing means and said frame, said table being movable relative to said frame to transfer one of said boards between said first location and said second location, said table also being movable relative to said frame to transport another of said boards between said first location and said third location;

said reciprocating movement imparting means including a track and roller system for supporting said table for linear motion relative to said foam removing means and said frame and a drive cylinder associated with said table for imparting linear motion to said table through said track and roller system, said foam removing means including a pair of blades positioned closely adjacent and above said table for forming said V-shaped grooves in said foam of said boards during relative movement therebetween;

said pair of blades of said foam removing means removing foam as a first one of said boards moves with said table from said first location to said second location and also as a second one of said boards moves with said table from said first location to said third location;

foam separating means for separating the portion of the foam comprising said grooves from the remainder of said boards after said grooves have been formed in said boards by said foam removing means;

said foam separating means including a pin for separating each portion of the foam comprising each of said grooves in said boards as said first one of said boards moves from said second location to said first location and also as said second one of said boards moves from said third location to said first location; and a removing station located generally adjacent said first location for removing said boards from said table after said grooves have been formed and said foam has been separated;

said foam removing means operating on said second one of said boards while said foam separating means is operating on said first one of said boards;

said first one of said boards being removed from said table at said removing station when said table is at said first location after said foam separating means has separated material from said first one of said boards;

a third one of said boards being fed to said table from said feeding station while said table is still at said first location following removal of said first one of said boards.

10. The apparatus of claim 9 wherein said board feeding station is positioned on one side of said board-receiving table and said board removing station is positioned on the other side of said board-receiving table.

11. The apparatus of claim 9 including vacuum means associated with said table for maintaining said generally planar board in a flat position in said generally horizontal plane on said board-receiving table.

12. The apparatus of claim 9 wherein said board-receiving table includes a stop for positioning one edge of said boards thereagainst and a marking for positioning another edge of said boards thereagainst.

13. The apparatus of claim 9 wherein said foam separating means includes a plurality of reciprocating pins for engaging the portions of the foam comprising said grooves after said grooves have been formed by said foam removing means.

14. An apparatus for cutting a plurality of V-shaped grooves in a board of foam having a puzzle facing material thereon to form foldable corner pieces for a three-dimensional puzzle, comprising:

a generally rectangular frame supported by a plurality of legs;

a station centrally positioned along one side of said frame for feeding said board from a supply of said boards;

means for supporting said board upon receipt from said station comprising:

a generally rectangular board-receiving table supported by said frame so as to be disposed in a generally horizontal plane and said board being generally rectangular and planar so as to be positioned flat upon an upper surface of said table;

means for forming said grooves in said board while said board is supported on said table including:

means for removing a portion of said foam comprising said board to form said V-shaped grooves therein and means for imparting relative movement between said board-receiving table and said foam removing means, said relative movement imparting means including a track and roller system for supporting said board-receiving table for linear motion toward and away from opposite ends of said rectangular frame and relative to said foam removing means and a drive cylinder associated with said board-receiving table for imparting linear motion of a preselected distance to said board-receiving table through said track and roller system, said foam removing means including a plurality of fixedly mounted cutters each having a pair of blades positioned closely adjacent and above said board-receiving table for forming said V-shaped grooves in said foam of said board during relative movement therebetween;

means for separating the portion of the foam comprising said groove from the remainder of said board after said groove has been formed in said board by said groove forming means; and a station centrally positioned along the other side of said frame from said feeding station for removing said board after said grooves have been formed;

said foam separating means including a plurality of reciprocating pin assemblies each including a reciprocating pin pivotally mounted on a supporting block positioned on a rod extending generally from one side of said frame to the other side of said frame for engaging the portion of the foam comprising said groove after said groove has been formed by said groove forming means.

15. The apparatus of claim 14 wherein said rod is supported at opposite ends by said frame and said pins are each carded by one end of an arm having an intermediate pivot point and including spring means for normally biasing said pin in a direction away from the portion of said foam comprising said groove.

16. The apparatus of claim 15 wherein said pin assemblies each include means for releasably securing said supporting block in a selected horizontal position of adjustment along said rod and including means for imparting pivotal movement to said pin against normal biasing by said spring means.

17. The apparatus of claim 16 wherein said pin assemblies each include a pin stripper mounted on said supporting block through which said pin moves first to engage and separate the portion of said foam comprising said groove from said board and then to discard the portion of said foam comprising said groove.

18. The apparatus of claim 17 wherein said pivotal movement imparting means includes a pivotally mounted rod assembly overlying said arms of said pin assemblies opposite said pins and a drive cylinder associated with said pin assemblies for pivoting said arms and pins against normal biasing by said spring means.

19. The apparatus of claim 18 wherein said cutters are positioned on each side of and generally adjacent said feeding and removing stations, and said pin assemblies are positioned generally outwardly of and in longitudinal alignment with said cutters in proximity to each of said opposite ends of said frame.

20. The apparatus of claim 19 wherein said drive cylinder associated with said board-receiving table first imparts linear motion of a preselected distance toward one end of said frame, stops, and then imparts linear motion of a preselected distance toward the other end of said frame.

21. The apparatus of claim 26 including control means for controlling operation of said drive cylinder associated with said board-receiving table and said pin assemblies such that said pins engage the portion of said foam comprising said grooves after said board-receiving table has travelled said preselected distance.

22. An apparatus for cutting a plurality of V-shaped grooves in a board of foam having a puzzle facing material thereon to form foldable corner pieces for a three-dimensional puzzle, comprising:

a generally rectangular frame supported by a plurality of legs;

a station centrally positioned along one side of said frame for feeding said board from a supply of said boards;

means for supporting said board upon receipt from said station comprising:

a generally rectangular board-receiving table supported by said frame so as to be disposed in a generally horizontal plane and said board being generally rectangular and planar so as to be positioned flat upon an upper surface of said table;

means for forming said grooves in said board while said board is supported on said table including:

means for removing a portion of said foam comprising said board to form said V-shaped grooves therein and means for imparting relative movement between said board-receiving table and said foam removing means, said relative movement imparting means including a track and roller system for supporting said board-receiving table for linear motion toward and away from opposite ends of said rectangular frame and relative to said foam removing means and a drive cylinder associated with said board-receiving table for imparting linear motion of a preselected distance to said board-receiving table through said track and roller system, said foam removing means including a plurality of cutters each having a pair of blades positioned closely adjacent and above said board-receiving table for forming said V-shaped grooves in said foam of said board during relative movement therebetween, wherein said cutters each include a supporting block mounted on a pair of rods extending generally from one side of said frame to the other side of said frame so as to be supported at opposite ends by said frame and a blade carrying face plate mounted to said supporting block, and wherein said face plates each include a generally V-shaped blade carrying extension disposed below said supporting block and said blades comprise razor blades secured to said blade carrying extension inclined downwardly and rearwardly in the direction of travel of said board;

means for separating the portions of the foam comprising said grooves from the remainder of said board after said grooves have been formed in said board by said foam removing means; and a station centrally positioned along the other side of said frame from said feeding station for removing said board after said grooves have been formed;

said foam separating means including a plurality of reciprocating pins for engaging the portions of the foam comprising said grooves after said grooves have been formed by said groove forming means.

23. A method for cutting a plurality of V-shaped grooves in boards of foam having a puzzle facing material thereon to form foldable corner pieces for a three-dimensional puzzle, comprising:

feeding said boards one at a time from a supply of said boards at a feeding station onto a generally rectangular board-receiving table where said boards are generally rectangular and planar;

supporting said boards on said board-receiving table so as to be disposed flat and in a generally horizontal plane after said boards have been fed at said feeding station;

said table being supported by a frame, said frame including a first location generally adjacent said feeding station for receiving said boards from said feeding station, said frame also including a second location and a third location;

said second location being positioned on one side of said first location and spaced from said feeding station, said third location being positioned on the other side of said first location and spaced from said feeding station;

forming said grooves in said boards while said boards are supported on said table including the steps of:

removing portions of said foam comprising said boards to form said V-shaped grooves therein by imparting reciprocating movement to said board-receiving table relative to a foam removing means and said frame, said table being movable relative to said frame to transfer one of said boards between said first location and said second location, said table also being movable relative to said frame to transport another of said boards between said first location and said third location, said relative movement being imparted by causing oppositely directed linear motion of said board-receiving table of a preselected distance in each direction relative to said foam removing means, said foam removing means including a plurality of fixedly mounted cutters each having a pair of blades positioned closely adjacent and above said board-receiving table;

said fixedly mounted cutters of said foam removing means removing foam during relative movement between said table and said fixedly mounted cutters of said foam removing means as a first one of said boards moves with said table from said first location to said second location and also as a second one of said boards moves with said table from said first location to said third location;

separating the portions of the foam comprising said grooves from the remainder of said boards by operation of a foam separating means after said grooves have been formed in said boards in said groove forming step;

removing said board from said board-receiving table at a removing station after forming said grooves in said groove forming step and separating the portion of the foam comprising said grooves;

said foam separating means separating foam during relative movement between said table and said foam separating means as said boards move from said second location to said first location and also during relative movement between said table and said foam separating means as said boards move from said third location to said first location;

removing the portions of said foam comprising said grooves on a second one of said boards while separating the portions of said foam comprising said grooves on a first one of said boards;

removing said first one of said boards from said first location at said removing station after said foam separation;

and feeding a third one of said boards to said first location at said feeding station following removal of said first one of said boards.

24. The method of claim 23 wherein separating the portions of the foam includes the step of:

pivoting a plurality of pins to engage and separate each of the portions of said foam comprising one of said grooves in said board from the remainder of said boards and thereafter discarding the portions of said foam removed to form said grooves.

25. The method of claim 24 wherein forming said grooves includes the step of:

providing foam removing means on each side of and generally adjacent said feeding and removing stations, and providing said pins generally outwardly of and in longitudinal alignment with said foam removing means.

26. The method of claim 24 wherein the method includes the step of:

controlling operation by causing said pins to engage the portions of said foam comprising said grooves after said board-receiving table has travelled in linear motion by said preselected distance relative to said foam removing means.

* * * * *